US012203208B2

(12) United States Patent
Borgerson

(10) Patent No.: US 12,203,208 B2
(45) Date of Patent: Jan. 21, 2025

(54) INSULATION PANEL FOR BACK PANEL OF LAUNDRY APPLIANCE

(71) Applicant: WHIRLPOOL CORPORATION, Benton Harbor, MI (US)

(72) Inventor: Matthew E. Borgerson, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 913 days.

(21) Appl. No.: 17/241,302

(22) Filed: Apr. 27, 2021

(65) Prior Publication Data

US 2022/0341084 A1 Oct. 27, 2022

(51) Int. Cl.
*D06F 58/20* (2006.01)
*D06F 58/04* (2006.01)

(52) U.S. Cl.
CPC ..... *D06F 58/20* (2013.01); *D06F 58/04* (2013.01)

(58) Field of Classification Search
None
See application file for complete search history.

(56) References Cited

U.S. PATENT DOCUMENTS

| | | | |
|---|---|---|---|
| 6,618,958 B2 | 9/2003 | Myung et al. | |
| 2018/0371677 A1 | 12/2018 | Oak et al. | |

FOREIGN PATENT DOCUMENTS

| | | | | |
|---|---|---|---|---|
| CN | 104562602 | | 4/2015 | |
| DE | 102015214205 | | 3/2016 | |
| EP | 0265332 | | 4/1988 | |
| EP | 1832678 B1 | * | 6/2012 | ..... D06F 58/02 |
| EP | 2631353 A1 | * | 8/2013 | ..... D06F 58/04 |
| EP | 3249093 A1 | | 11/2017 | |
| EP | 3333306 A1 | | 6/2018 | |
| NL | 1016031 | * | 3/2002 | |
| WO | 2009026591 A1 | | 2/2009 | |
| WO | WO-2013127785 A2 | * | 9/2013 | ..... D06F 58/04 |
| WO | 2018082625 | | 5/2018 | |

* cited by examiner

*Primary Examiner* — Jason Lau
(74) *Attorney, Agent, or Firm* — Price Heneveld LLP

(57) ABSTRACT

A drying appliance includes an outer cabinet having a back panel. A rotating drum is positioned adjacent to an arcuate recess of the back panel. A blower delivers process air through an airflow path that includes the rotating drum. The airflow path extends through an airway defined within the arcuate recess of the back panel and through a rear wall of the drum. An insulation panel is positioned between the rear wall of the drum and the back panel of the outer cabinet. The insulation panel occupies the arcuate recess and partially surrounds the airway to prevent accumulation of lint within the arcuate recess. The insulation panel is configured to prevent thermal transfer from a processing space within the rotating drum and an area rearward of the back panel.

20 Claims, 8 Drawing Sheets

INSULATION PANEL FOR BACK PANEL OF LAUNDRY APPLIANCE

BACKGROUND OF THE DISCLOSURE

The present disclosure generally relates to laundry appliances, and more specifically, a laundry appliance that includes an insulation panel positioned between a rotating drum and a back panel for occupying a space therebetween to define the airflow path and also prevent the accumulation of lint behind the rotating drum.

SUMMARY OF THE DISCLOSURE

According to one aspect of the present disclosure, a drying appliance includes an outer cabinet having a back panel. A rotating drum is positioned adjacent to an arcuate recess of the back panel. A blower delivers process air through an airflow path that includes the rotating drum. The airflow path extends through an airway defined within the arcuate recess of the back panel and through a rear wall of the drum. An insulation panel is positioned between the rear wall of the drum and the back panel of the outer cabinet. The insulation panel occupies the arcuate recess and partially surrounds the airway to prevent accumulation of lint within the arcuate recess. The insulation panel is configured to prevent thermal transfer from a processing space within the rotating drum and an area rearward of the back panel.

According to another aspect of the present disclosure, a drying appliance includes a rotating drum having a perforated rear wall and a back panel of an outer cabinet. The rotating drum is rotationally attached to the rear wall via a pivot. The rotating drum is positioned within the outer cabinet. An insulation panel that is positioned to occupy an interstitial space defined between the perforated rear wall and the back panel. The insulation panel is further positioned to direct a flow of process air through an airway defined within the back panel and into the drum.

According to yet another aspect of the present disclosure, a drying appliance includes an outer cabinet having a back panel. A rotating drum includes a perforated rear wall that is positioned adjacent to an arcuate recess of the back panel. A blower delivers process air through an airflow path that includes the rotating drum. The airflow path extends through an airway defined within the arcuate recess of the back panel, through an interstitial space between the perforated rear wall and the back panel and through the perforated rear wall of the drum. An insulation panel is positioned between the rear wall of the drum and the back panel of the outer cabinet. The insulation panel occupies the arcuate recess and partially surrounds the airway to define the airflow path within the interstitial space. The insulation panel is further configured to prevent accumulation of lint within the arcuate recess.

These and other features, advantages, and objects of the present disclosure will be further understood and appreciated by those skilled in the art by reference to the following specification, claims, and appended drawings.

Figure 1:
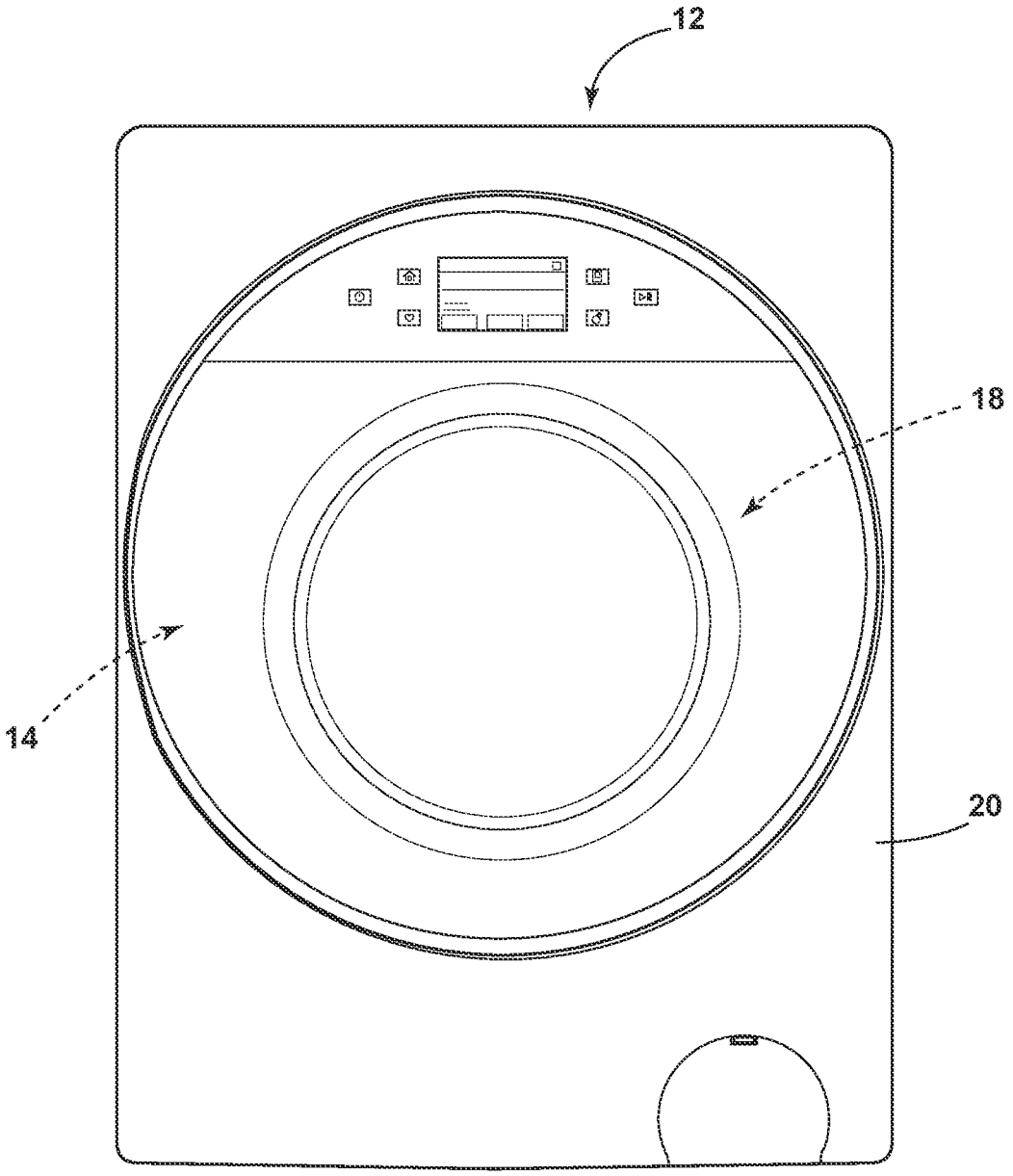
FIG. 1 is a front elevation view of a combination washing and drying appliance that incorporates an aspect of the insulation panel.
Figure 2:
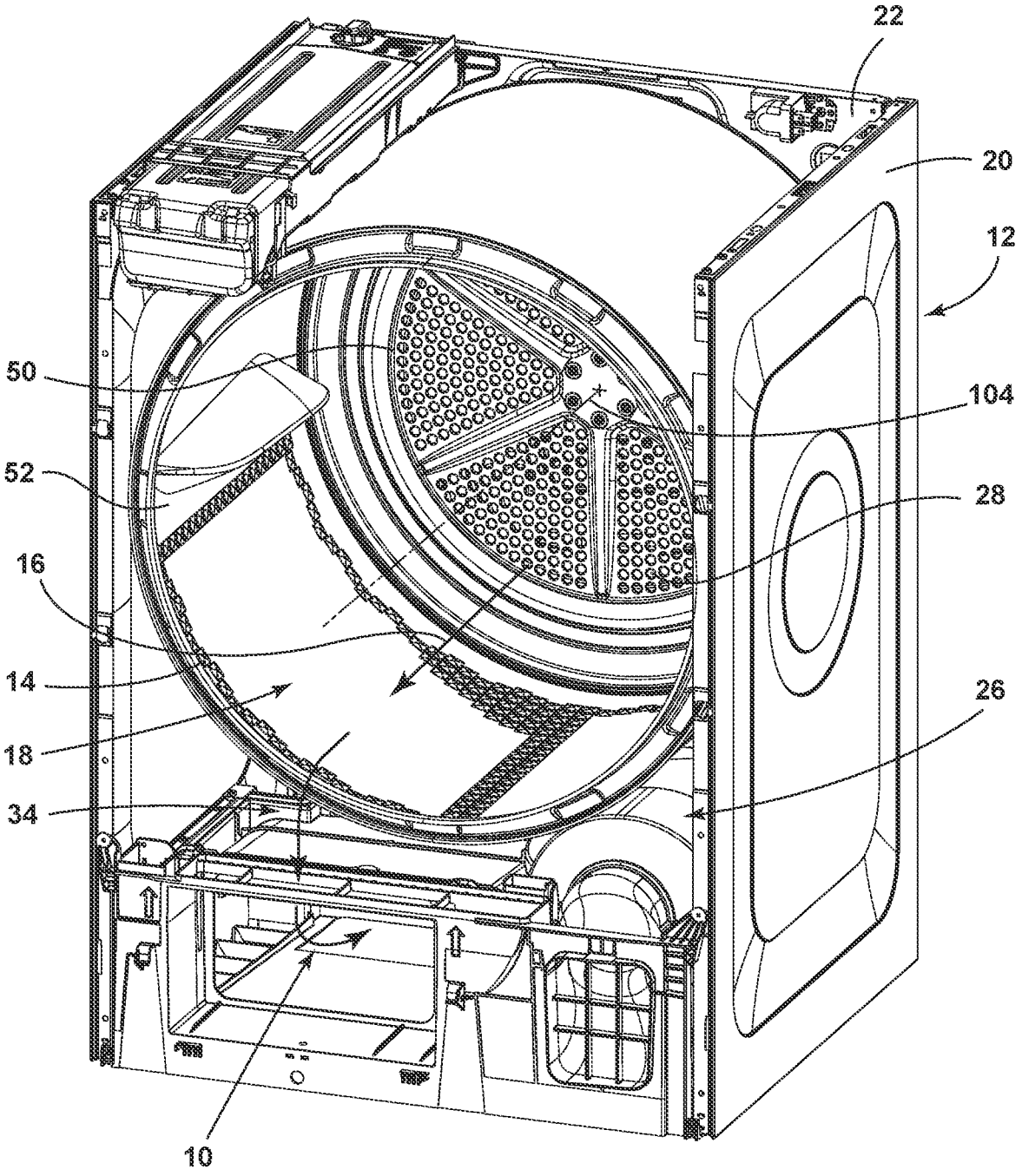
FIG. 2 is a perspective view of a laundry appliance that incorporates an aspect of the insulation panel and with portions of the outer cabinet removed.
Figure 3:
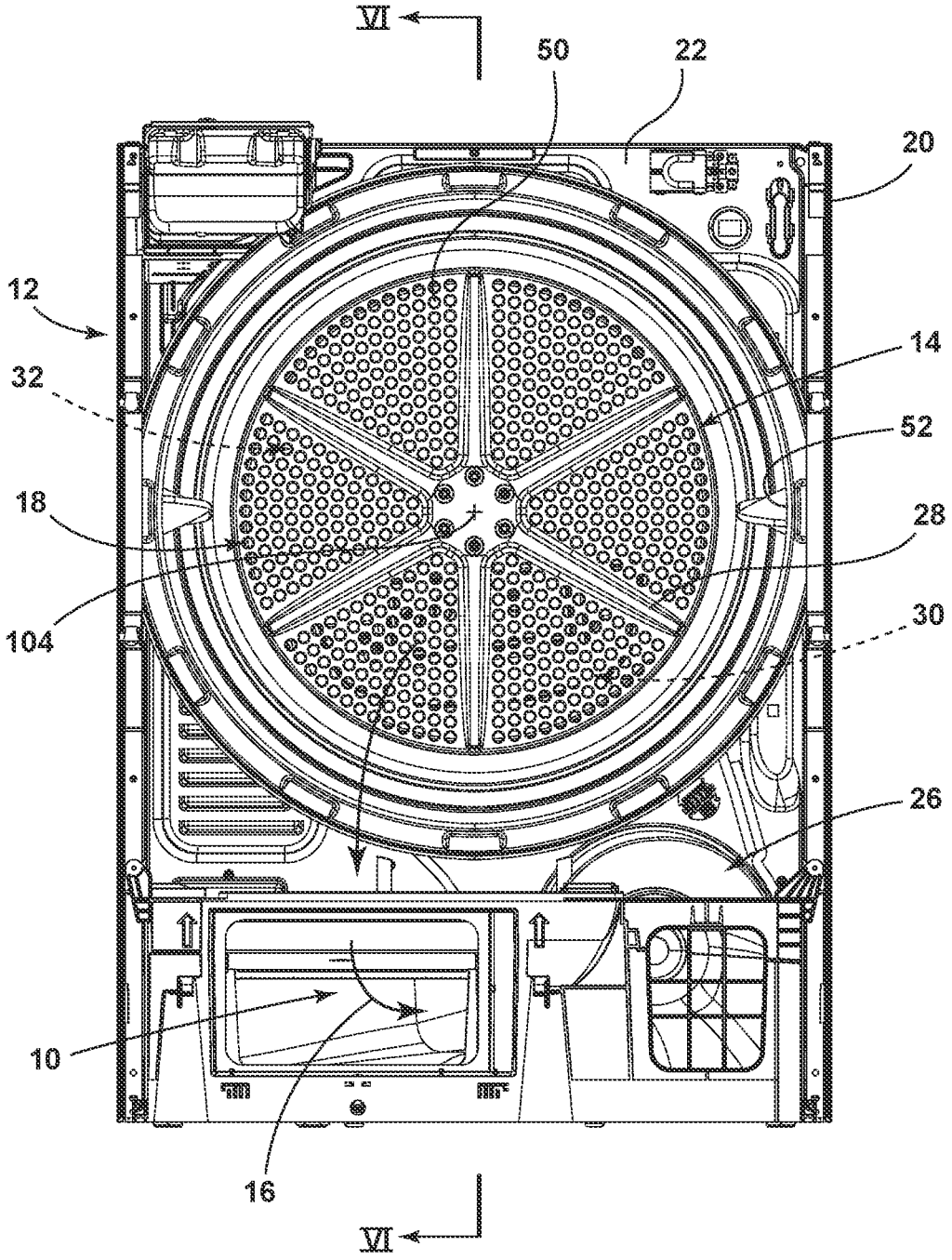
FIG. 3 is a front elevational view of the laundry appliance of FIG. 2.
Figure 4:
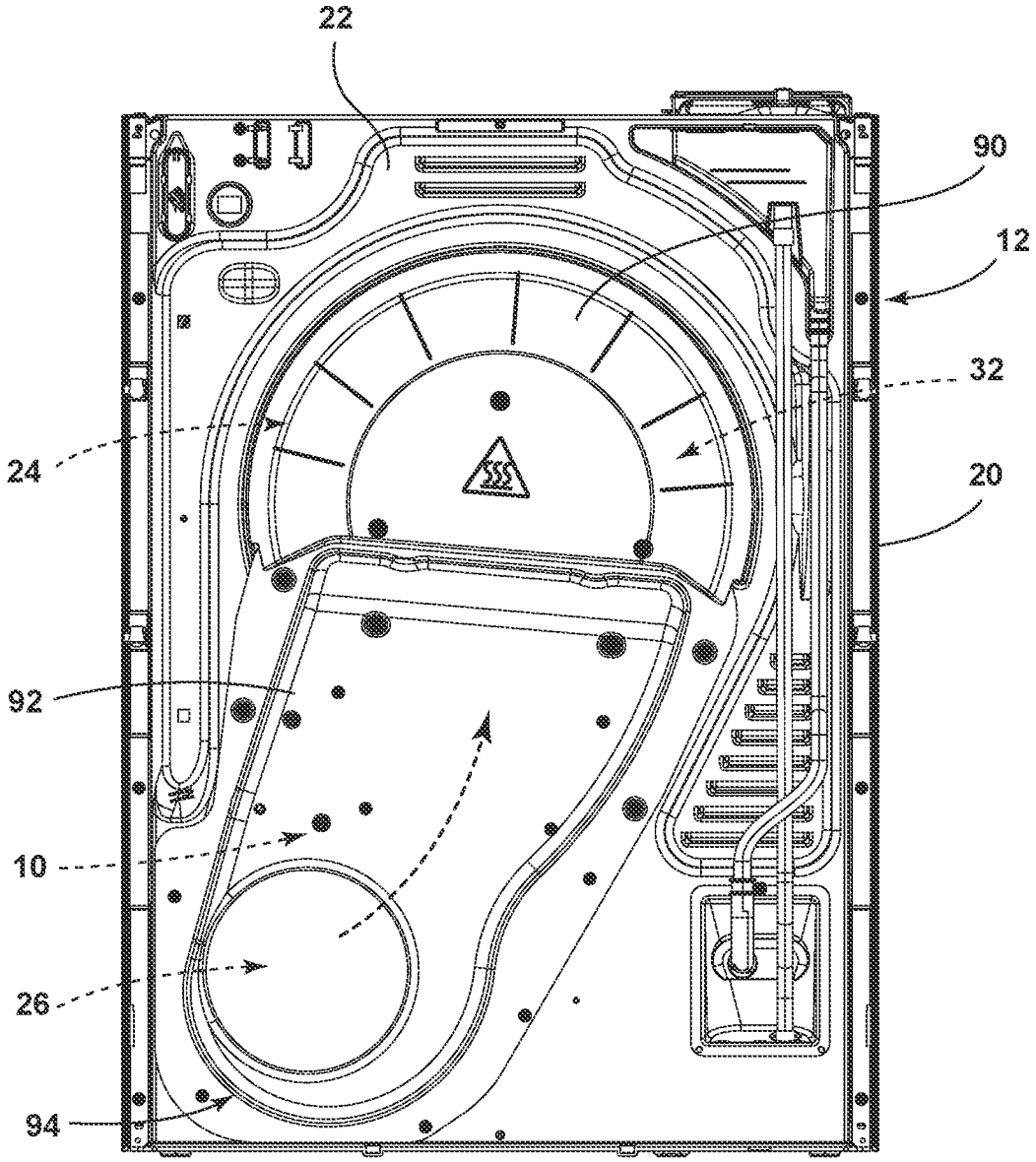
FIG. 4 is a rear elevational view of the laundry appliance of FIG. 2.
Figure 5:
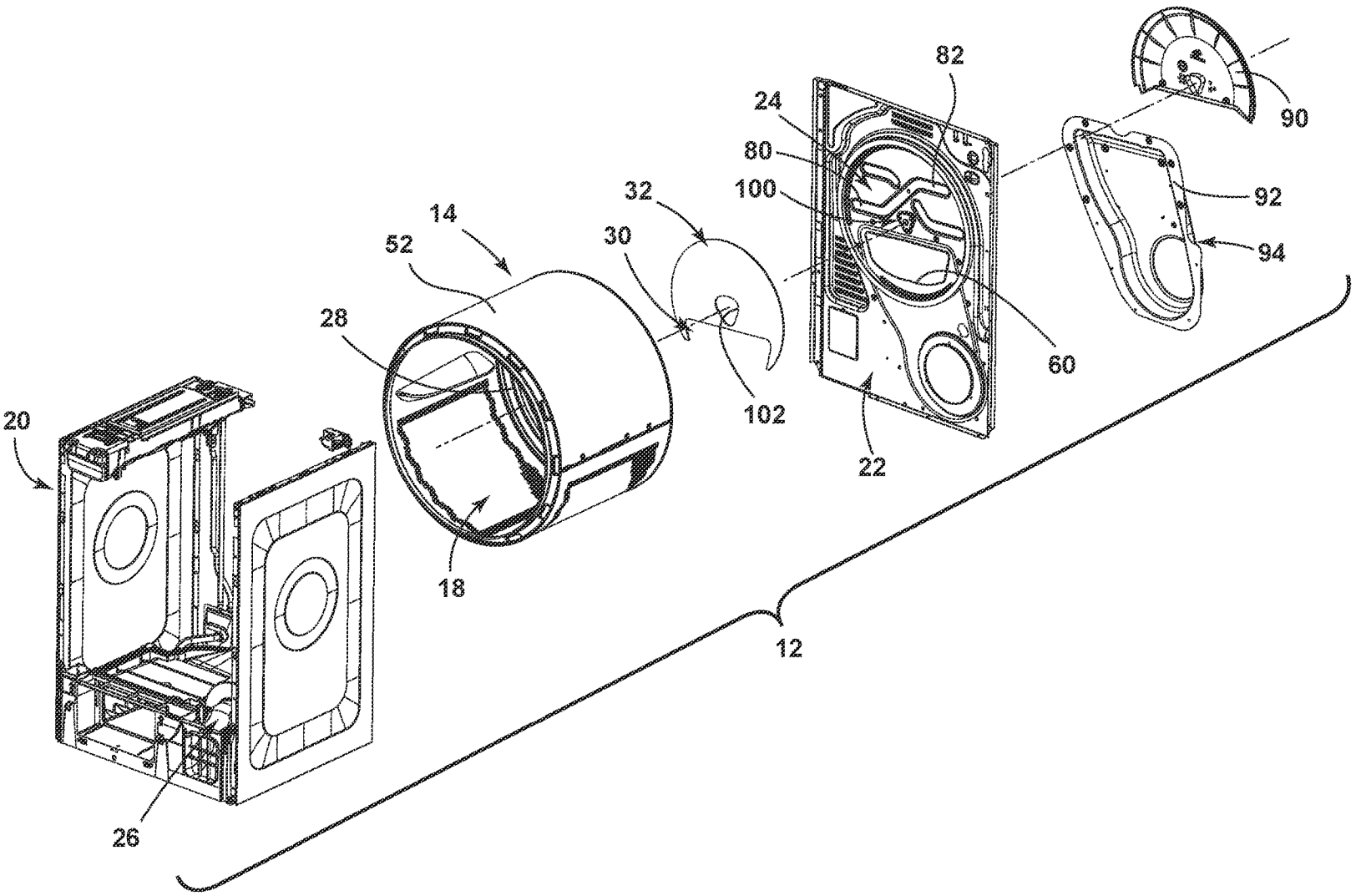
FIG. 5 is an exploded perspective view of the laundry appliance of FIG. 2.
Figure 6:
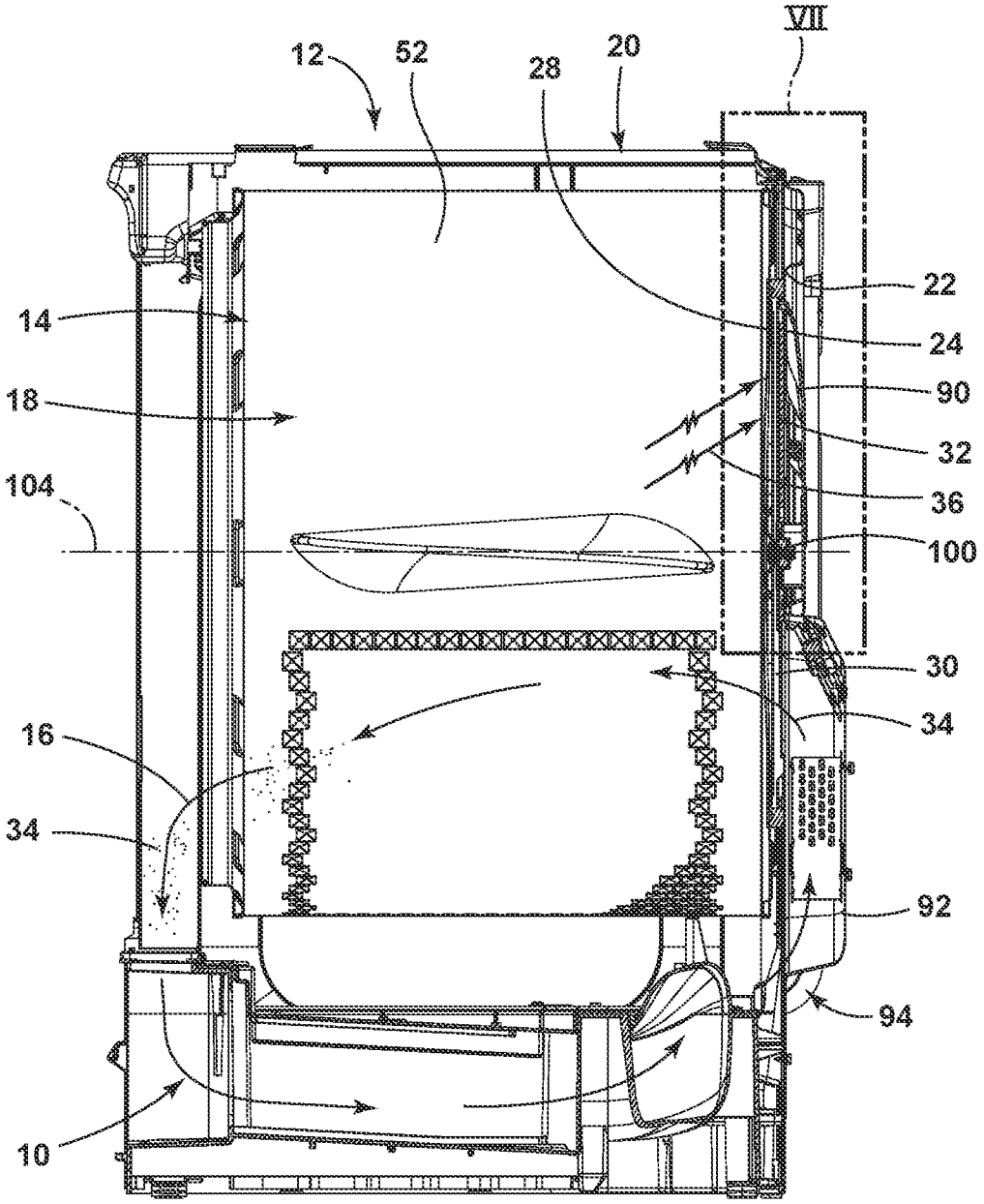
FIG. 6 is a cross-sectional view of the laundry appliance of FIG. 3 taken along line VI-VI.
Figure 7:
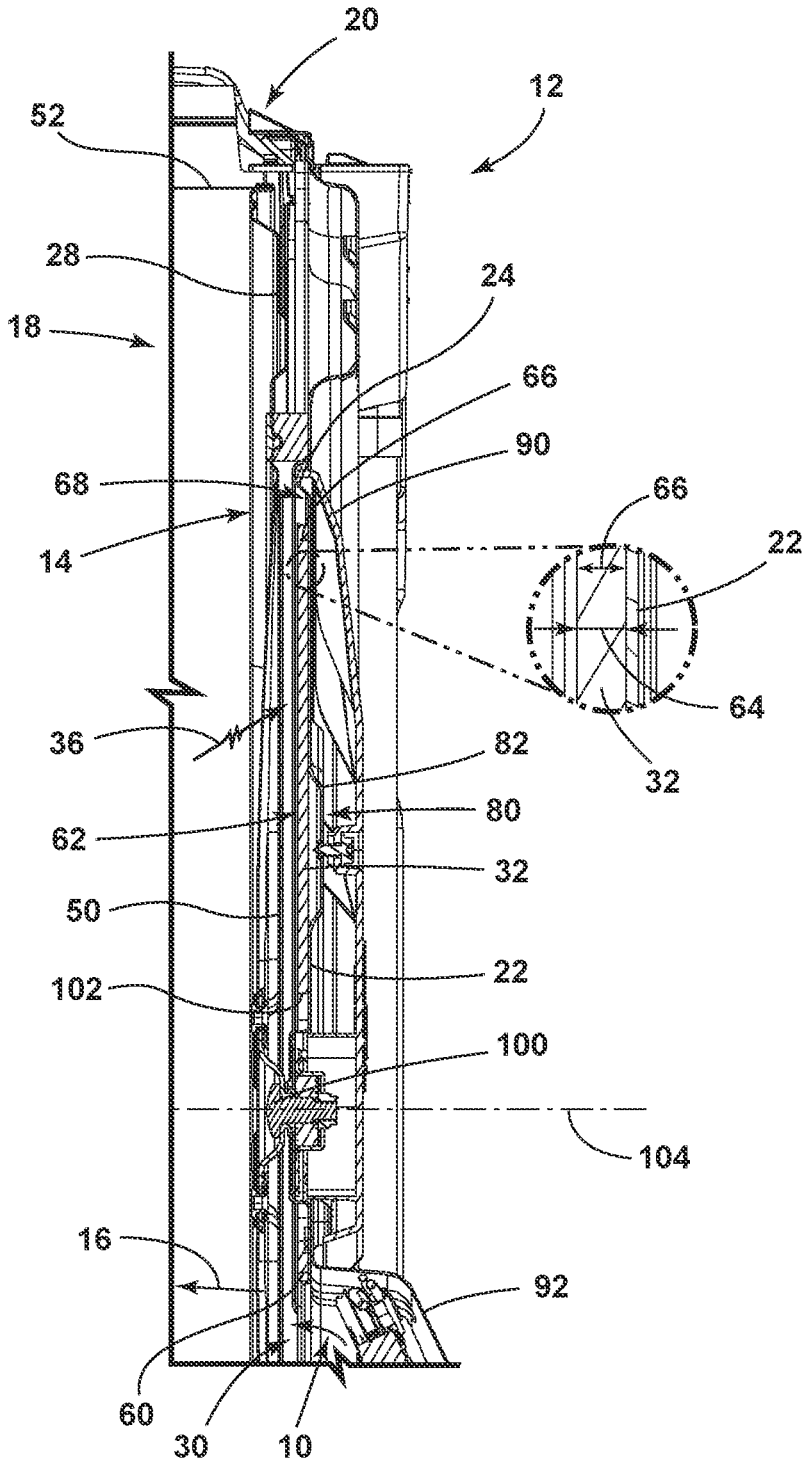
FIG. 7 is an enlarged cross-sectional view of the laundry appliance of FIG. 6 taken at area VII.
Figure 8:
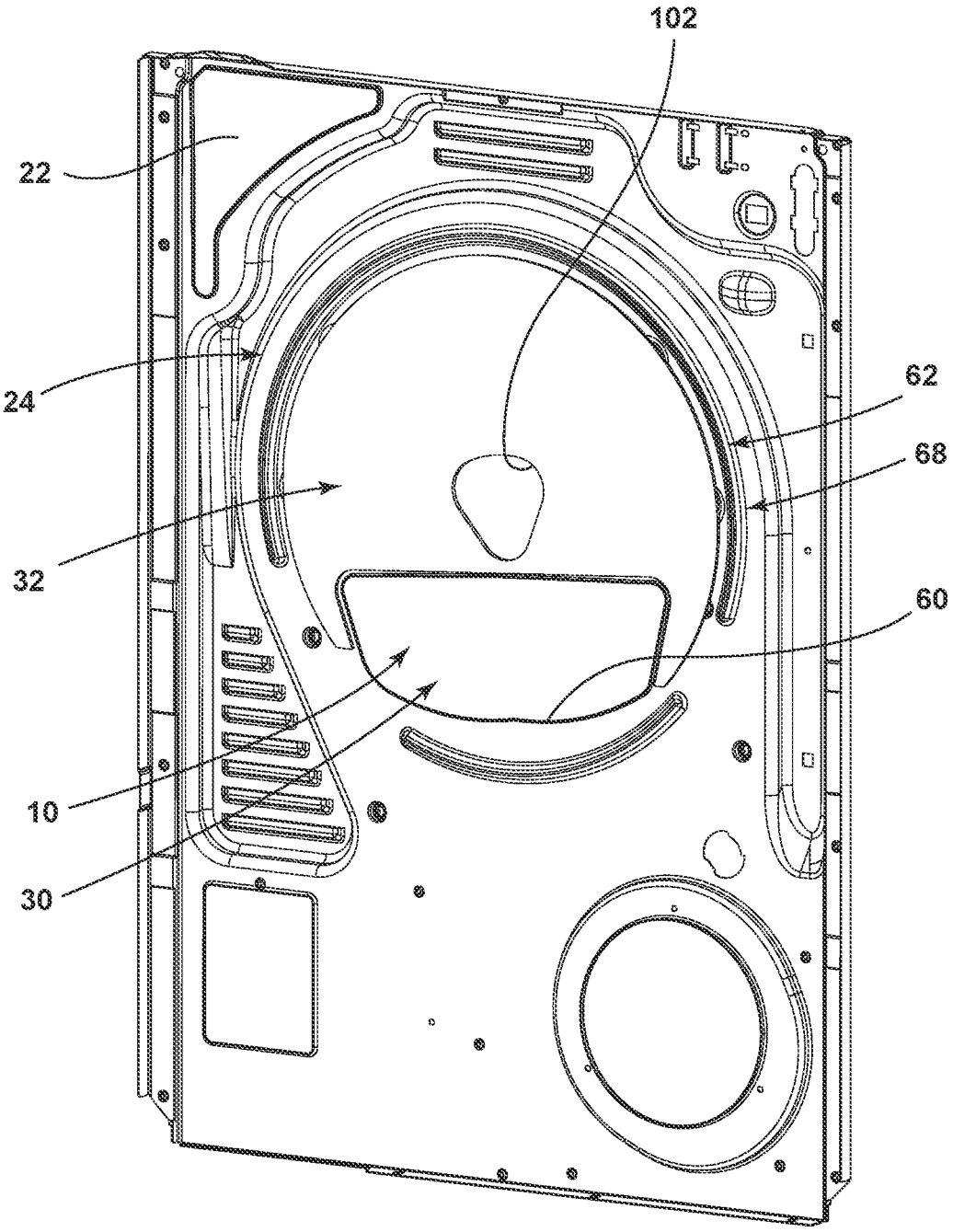
FIG. 8 is a perspective view of a cover panel for a laundry appliance that includes a rotational support for the rotating drum.

The components in the figures are not necessarily to scale, emphasis instead being placed upon illustrating the principles described herein.

DETAILED DESCRIPTION

The present illustrated embodiments reside primarily in combinations of method steps and apparatus components related to an insulation panel that defines an airway between a rotating drum and tub for a laundry appliance and prevents thermal transfer away from the airway. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-8, reference numeral 10 generally refers to an airflow path for a laundry appliance 12, typically a drying appliance. The drying appliance 12 includes a rotating drum 14 that defines a portion of the airflow path 10 and through which process air 16 is delivered for dehumidifying damp laundry articles that are contained within a processing space 18 of the rotating drum 14. According to various aspects of the device, the drying appliance 12 includes an outer cabinet 20 having a back panel 22. The rotating drum 14 is positioned adjacent to an arcuate recess 24 of the back panel 22. A blower delivers process air 16 through the airflow path 10 that includes the rotating drum 14. The airflow path 10 extends through a rear wall 28 of the drum 14 and through an airway 30, defined within the arcuate recess 24 of the back panel 22. An insulation panel 32 is positioned between the rear wall 28 of the drum 14 and the back panel 22 of the outer cabinet 20. The insulation panel 32 occupies the arcuate recess 24 and partially surrounds the airway 30 to prevent accumulation of particulate material 34, such as lint, within the arcuate recess 24. The insulation panel 32 is also configured to prevent thermal transfer of heat 36 from the processing space 18 within the rotating drum 14 and an area rearward of the back panel 22 of the outer cabinet 20.

Referring again to FIGS. 2-8, the rear wall 28 of the drum 14 includes a perforated wall 50 that defines a portion of the airflow path 10. This perforated wall 50 of the rotating drum 14 rotates with the cylindrical wall 52 of the rotating drum 14 during operation of the laundry appliance 12. Accordingly, during operation of the rotating drum 14, portions of the perforated wall 50 align with the airway 30 that is defined within the arcuate recess 24 of the back panel 22. Accordingly, as the laundry appliance 12 operates, process air 16 is directed through the perforated wall 50 of the rotating drum 14 and into the processing space 18. The process air 16 is only allowed to move through those portions of the perforated wall 50 that are aligned with the airway 30 defined within the arcuate recess 24 of the back panel 22. The insulation panel 32 is positioned to at least partially obstruct those portions of the perforated wall 50 that are out of alignment with the airway 30. Accordingly, process air 16, including particulate material 34 contained therein, is directed through the airway 30. This serves to at least partially prevent the accumulation of particulate material 34 within those portions of the arcuate recess 24 that are outside of the airway 30. In addition, the process air 16 is typically heated as it moves through the rotating drum 14. The positioning of the insulation panel 32 serves to prevent thermal transfer of heat 36 within the process air 16 from transferring through portions of the back panel 22 that are outside or distal from the airway 30. Because the perforated wall 50 of the rotating drum 14 rotates with the remainder of the rotating drum 14, the insulation panel 32 is coupled to the back panel 22 of the outer cabinet 20 to allow for freedom of rotation of the rear wall 28 of the rotating drum 14.

Referring again to FIGS. 2-8, the arcuate recess 24 of the back panel 22 includes the insulation panel 32. In this manner, the insulation panel 32 and the arcuate recess 24 serve to define the airway 30. The insulation panel 32 extends from an aperture 60 of the airway 30 and defines a portion of the airflow path 10 within an interstitial space 62 that is defined between the rear wall 28 of the drum 14 and the back panel 22 of the outer cabinet 20. This interstitial space 62 has a substantially consistent depth 64 between the rear wall 28 of the rotating drum 14 and the back panel 22 of the outer cabinet 20. Similarly, the insulation panel 32 has a similarly consistent thickness 66 to occupy the depth 64 of this interstitial space 62 that is defined by the arcuate recess 24. Through this configuration, the arcuate recess 24 defines the airflow path 10 within one portion of the arcuate recess 24 and also defines an insulating space 68 that receives the insulation panel 32. The insulation panel 32 in the insulating space 68 surrounds the airway 30 to define a portion of the airflow path 10. The insulation panel 32 also occupies this interstitial space 62 to prevent the accumulation of particulate material 34 within the insulating space 68 of the arcuate recess 24. In addition, the insulation panel 32 also prevents the thermal transfer of heat 36 through the back panel 22 of the outer cabinet 20.

To support the configuration of the arcuate recess 24, the arcuate recess 24 includes a plurality of structural channels 80 that define reinforcing spaces within the back panel 22 of the arcuate recess 24. These structural channels 80 serve to prevent deflection of the arcuate recess 24 during operation of the laundry appliance 12. Certain pressure of the process air 16 as it moves throughout the rotating drum 14 can exert outward forces against the insulation panel 32 in the arcuate recess 24. These structural channels 80 reinforce the arcuate recess 24 of the back panel 22 of the outer cabinet 20 to prevent deflection of the insulation panel 32 and the back panel 22. In addition, the insulation panel 32 can include indentations 82 that matingly engage the structural channels 80. In this manner, the structural channels 80 serve as a locating feature for positioning and orienting the insulation panel 32.

Because the arcuate recess 24 defines a stable and consistent portion of the airflow path 10, the insulation panel 32 is attached to the back panel 22 of the outer cabinet 20 and is stationary with respect to the rotating drum 14. As discussed above, those portions of the perforated wall 50 of the rotating drum 14 that are aligned with the airway 30 of the arcuate recess 24 define the airflow path 10 that allows process air 16 to move from downstream portions of the airflow path 10 that are behind the back panel 22 and into the processing space 18 defined within the rotating drum 14. In this manner, the process air 16 moves through the interstitial space 62 having the insulation panel 32. The process air 16 enters the processing space 18 via the airway 30 that extends thorough the interstitial space 62, wherein the airway 30 is defined by the insulation panel 32.

Referring again to FIGS. 2-8, the outer cabinet 20 includes a rear cover 90 that surrounds an area rearward of the arcuate recess 24 of the back panel 22. In addition, an external duct 92 is attached to the back panel 22 that extends from a lower portion 94 of the outer cabinet 20 and to the back panel 22 proximate the airway 30. Through this configuration, the rear cover 90 and the external duct 92 cooperate to surround the arcuate recess 24 and also define the airflow path 10 that extends from the blower 26 of the appliance 12, through the airway 30 and into the processing space 18 via the rear wall 28 of the rotating drum 14.

Referring again to FIGS. 2-8, the rear cover 90 of the outer cabinet 20 includes a pivot 100 that attaches the rotating drum 14 to the outer cabinet 20. This pivot 100 extends through the back panel 22 and through the insulation panel 32 and attaches to the rear wall 28 of the rotating drum 14. In this configuration, the insulation panel 32 includes an interior aperture 102 that surrounds the pivot 100 to prevent accumulation of particulate material 34 from surrounding the pivot 100. Accordingly, by preventing the accumulation of particulate material 34 on the pivot 100, the pivot 100 can be free of obstructions for an extended period of time, where such obstructions may be lint particles, and other particulate material 34 might accumulate within the process air 16 as it moves through the airflow path 10.

According to various aspects of the device, the insulation panel 32 can include any one of various insulating materials that can be used to prevent thermal transfer of heat 36 from process air 16 within the rotating drum 14 and through the back panel 22 of the outer cabinet 20. These insulating materials can include silica-type materials, glass spheres, hollow glass spheres, polymeric foam, combinations thereof, and other similar insulating materials. The insulation panel 32 can also be in the form of a vacuum insulated panel, pressed insulation panel 32, or other similar insulation panel 32 that has a generally stable and rigid structure for occupying the insulation space of the arcuate recess 24. Typically, the insulation panel 32 is surrounded by a barrier film or other similar covering material that maintains the insulation panel 32 in a consistent shape over the life of the appliance 12.

Referring again to FIGS. 1-8, the drying appliance 12 includes the rotating drum 14 having a perforated rear wall 28. The back panel 22 of the outer cabinet 20 can include a rear cover 90, where the rotating drum 14 is rotationally attached to the rear wall 28 and/or the rear cover 90 by a pivot 100. The rotating drum 14 is positioned within the outer cabinet 20. The insulation panel 32 is positioned to occupy the interstitial space 62 that is defined between the perforated rear wall 28 and the back panel 22. This insulation panel 32 is further positioned to direct a flow of process air 16 from the airway 30 that is defined between the rear wall 28 and the back panel 22 and into the rotating drum 14. To further position the insulation panel 32, the back panel 22 of the outer cabinet 20 includes the arcuate recess 24. The insulation panel 32 is positioned within the arcuate recess 24 to define the airway 30 and at least a portion of the airflow path 10 that exits the rotating drum 14 through the perforated rear wall 28. In this manner, the insulation panel 32 at least partially surrounds the airway 30 of the back panel 22 to define the airflow path 10. The insulation panel 32 includes an interior aperture 102 that allows the pivot 100 to extend therethrough to engage and rotationally support the rotating drum 14. To further position the insulation panel 32, the insulation panel 32 is typically adhered to the back panel 22 of the outer cabinet 20. This attachment of the insulation panel 32 to the rear wall 28 allows for rotational operation of the rotating drum 14, including the perforated rear wall 28 about a rotational axis 104 of the drum 14 during operation of the laundry appliance 12. In this manner, the insulation panel 32 is positioned to direct the process air 16 from the airway 30, including any particulate material 34, that is defined by the insulation panel 32 and the back panel 22 of the outer cabinet 20 and into the processing space 18 of the rotating drum 14. This prevents particulate material 34 from entering into other sections of the interstitial space 62 outside of the airway 30. The airway 30 is positioned in an offset configuration within the arcuate recess 24. This offset positioning allows for the pivot 100 to engage the rear wall 28 of the drum 14 through the interior aperture 102 of the insulation panel 32.

Within conventional laundry appliances, a perforated section of the processing drum allows process air to move through the entire perforated section of the processing drum. In such a configuration, process air and trapped lint contained therein passes through each of the perforations. The space that is defined between the processing drum and a structural panel for the cabinet receives this process air. Over the life of the conventional laundry appliance, this process air can deposit particles of lint within this space defined between the processing drum and the structural panel. Over time, this lint can accumulate and can block various mechanical components of the laundry appliance.

According to various aspects of the device, by placing the insulation panel 32 within this interstitial space 62 between the perforated rear wall 28 of the rotating drum 14 and the back panel 22 of the outer cabinet 20, the process air 16 can be directed through the airway 30 defined within the back panel 22 and away from these mechanical components that can include, but are not limited to, the pivot 100, various bearings, and other mechanical components that serve to operate the rotating drum 14 and deliver process air 16. In addition, placement of the insulation panel 32 serves to contain heat 36 within the rotating drum 14 and prevent thermal transfer through portions of this interstitial space 62 that are distal from the airway 30. In addition, heat 36 can be contained within the airway 30 and the airflow path 10 to prevent premature condensation of the process air 16 as it moves through the airflow path 10. Accordingly, using the insulation panel 32, a limited amount of condensation may occur away from a heat exchange system for the laundry appliance 12.

Referring again to FIGS. 1-8, the drying appliance 12 includes the outer cabinet 20 having the back panel 22. The rotating drum 14 including the perforated rear wall 28 is positioned adjacent to an arcuate recess 24 of the back panel 22. The blower 26 delivers process air 16 through the airflow path 10 that includes the rotating drum 14. The airflow path 10 extends through the interstitial space 62 provided between the perforated rear wall 28 and the back wall and through an airway 30 defined within the arcuate recess 24 of the back panel 22. The airflow path 10 then extends through the perforated rear wall 28 of the drum 14 and into the processing space 18. The insulation panel 32 is positioned between the rear wall 28 of the drum 14 and the back panel 22 of the outer cabinet 20. This insulation panel 32 occupies the arcuate recess 24 and partially surrounds the airway 30 to define the airflow path 10 within this interstitial space 62. The insulation panel 32 is further configured to prevent accumulation of particulate material 34 within the arcuate recess 24 during operation of the laundry appliance 12.

Referring again to FIGS. 2-8, the insulation panel 32 is configured to prevent a thermal transfer of heat 36 from the processing space 18 within the rotating drum 14 and within an area rearward of the back panel 22. As discussed herein, this can prevent premature condensation of moist air that is delivered into the processing space 18 and back to a heat exchange mechanism for the laundry appliance 12. In certain exhaust-type laundry appliances 12, preventing premature condensation can also prevent the accumulation of lint particles within various dryer vents that extend from the appliance 12 to the atmosphere.

According to various aspects of the device, the insulation panel 32 described herein can be used within any one of various laundry appliances 12. Such laundry appliances 12 can include, but are not limited to, combination washing and drying appliances 12, condensation dryers, heat pump dryers, vented dryers, recirculating dryers, combinations thereof, and other similar laundry appliances 12.

As discussed herein, the incorporation of the insulation panel 32 is utilized for preventing the accumulation of lint particles within the interstitial space 62 between the perforated rear wall 28 of the rotating drum 14 and the back panel 22 of the outer cabinet 20. In addition, this insulation panel 32 is used to prevent the thermal transfer of heat 36 from the processing space 18 within the rotating drum 14 and through this interstitial space 62. Accordingly, heat 36 is maintained within the process air 16 that is moved through the airflow path 10 and toward the atmosphere, a heat exchange mechanism, or other condensation system of the laundry appliance 12.

According to another aspect of the present disclosure, a drying appliance includes an outer cabinet having a back panel. A rotating drum is positioned adjacent to an arcuate recess of the back panel. A blower delivers process air through an airflow path that includes the rotating drum. The airflow path extends through an airway defined within the arcuate recess of the back panel and through a rear wall of the drum. An insulation panel is positioned between the rear wall of the drum and the back panel of the outer cabinet. The insulation panel occupies the arcuate recess and partially surrounds the airway to prevent accumulation of lint within the arcuate recess. The insulation panel is configured to prevent thermal transfer from a processing space within the rotating drum and an area rearward of the back panel.

According to another aspect, the insulation panel is coupled to the back panel.

According to yet another aspect, the rear wall of the drum includes a perforated section that defines a portion of the airflow path.

According to another aspect of the present disclosure, the arcuate recess includes the insulation panel and defines the airway. The insulation panel extends from an aperture of the airway and defines the airflow path within an interstitial space defined between the rear wall of the drum and the back panel of the outer cabinet.

According to another aspect, the outer cabinet includes a rear cover that surrounds an area rearward of the arcuate recess.

According to yet another aspect, the rear cover includes a pivot that attaches the rotating drum to the outer cabinet. The pivot extends through the insulation panel.

According to another aspect of the present disclosure, an external duct is attached to the back panel and extends between the airway and a lower portion of the outer cabinet, proximate the blower.

According to another aspect, the insulation panel has a consistent thickness.

According to yet another aspect, the arcuate recess includes a plurality of structural channels that define reinforcing spaces within the back panel at the arcuate recess.

According to another aspect of the present disclosure, the insulation panel is stationary with respect to the rotating drum.

According to another aspect, a drying appliance includes a rotating drum having a perforated rear wall and a back panel of an outer cabinet. The rotating drum is rotationally attached to the rear wall via a pivot. The rotating drum is positioned within the outer cabinet. An insulation panel that is positioned to occupy an interstitial space defined between the perforated rear wall and the back panel. The insulation panel is further positioned to direct a flow of process air through an airway defined within the back panel and into the drum.

According to yet another aspect, the back panel includes an arcuate recess. The insulation panel is positioned within the arcuate recess.

According to another aspect of the present disclosure, the insulation panel at least partially surrounds the airway of the back panel.

According to another aspect, the insulation panel includes an inner aperture. The pivot extends through the inner aperture.

According to yet another aspect, the insulation panel is adhered to the back panel.

According to another aspect of the present disclosure, the insulation panel is configured to prevent thermal transfer from a processing space within the rotating drum and to an area rearward of the back panel.

According to another aspect, the insulation panel is positioned to direct the process air from the processing space and through the airway.

According to yet another aspect, a drying appliance includes an outer cabinet having a back panel. A rotating drum includes a perforated rear wall that is positioned adjacent to an arcuate recess of the back panel. A blower delivers process air through an airflow path that includes the rotating drum. The airflow path extends through an airway defined within the arcuate recess of the back panel, through an interstitial space between the perforated rear wall and the back panel and through the perforated rear wall of the drum. An insulation panel is positioned between the rear wall of the drum and the back panel of the outer cabinet. The insulation panel occupies the arcuate recess and partially surrounds the airway to define the airflow path within the interstitial space. The insulation panel is further configured to prevent accumulation of lint within the arcuate recess.

According to another aspect of the present disclosure, the insulation panel is configured to prevent thermal transfer from a processing space within the rotating drum and an area rearward of the back panel.

According to another aspect, the back panel includes a pivot that attaches the rotating drum to the outer cabinet. The pivot extends through the insulation panel. It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A drying appliance comprising:

an outer cabinet having a back panel;

a rotating drum positioned adjacent to an arcuate recess of the back panel;

a blower that delivers process air through an airflow path that includes the rotating drum, wherein the airflow path extends through an airway defined within the arcuate recess of the back panel and through a rear wall of the drum, wherein the arcuate recess includes a plurality of structural channels that define reinforcing spaces within the back panel at the arcuate recess; and an insulation panel that is positioned between the rear wall of the drum and the back panel of the outer cabinet, wherein the insulation panel occupies the arcuate recess and partially surrounds the airway to prevent accumulation of lint within the arcuate recess, wherein the insulation panel is configured to prevent thermal transfer from a processing space within the rotating drum and an area rearward of the back panel.

2. The drying appliance of claim 1, wherein the insulation panel is coupled to the back panel.

3. The drying appliance of claim 1, wherein the rear wall of the drum includes a perforated section that defines a portion of the airflow path.

4. The drying appliance of claim 1, wherein the arcuate recess includes the insulation panel and defines the airway, wherein the insulation panel extends from an aperture of the airway and defines the airflow path within an interstitial space defined between the rear wall of the drum and the back panel of the outer cabinet.

5. The drying appliance of claim 1, wherein the outer cabinet includes a rear cover that surrounds an area rearward of the arcuate recess.

6. The drying appliance of claim 5, wherein the rear cover includes a pivot that attaches the rotating drum to the outer cabinet, wherein the pivot extends through the insulation panel.

7. The drying appliance of claim 1, wherein an external duct is attached to the back panel and extends between the airway and a lower portion of the outer cabinet, proximate the blower.

8. The drying appliance of claim 1, wherein the insulation panel has a consistent thickness.

9. The drying appliance of claim 1, wherein the insulation panel is stationary with respect to the rotating drum.

10. A drying appliance comprising:

a rotating drum having a perforated rear wall;

a back panel of an outer cabinet, wherein the rotating drum is rotationally attached to the rear wall via a pivot, wherein the rotating drum is positioned within the outer cabinet; and an insulation panel that is positioned to occupy an interstitial space defined between the perforated rear wall and the back panel, wherein the insulation panel is further positioned to direct a flow of process air through an airway defined within the back panel and into the drum, wherein the insulation panel includes an inner aperture, and wherein the pivot extends through the inner aperture.

11. The drying appliance of claim 10, wherein the back panel includes an arcuate recess, wherein the insulation panel is positioned within the arcuate recess.

12. The drying appliance of claim 10, wherein the insulation panel at least partially surrounds the airway of the back panel.

13. The drying appliance of claim 10, wherein the insulation panel is adhered to the back panel.

14. The drying appliance of claim 10, wherein the insulation panel is configured to prevent thermal transfer from a processing space within the rotating drum and to an area rearward of the back panel.

15. The drying appliance of claim 14, wherein the insulation panel is positioned to direct the process air from the processing space and through the airway.

16. A drying appliance comprising:

an outer cabinet having a back panel;

a rotating drum having a perforated rear wall that is positioned adjacent to an arcuate recess of the back panel;

a blower that delivers process air through an airflow path that includes the rotating drum, wherein the airflow path extends through an airway defined within the arcuate recess of the back panel, through an interstitial space between the perforated rear wall and the back panel and through the perforated rear wall of the drum; and an insulation panel that is positioned between the rear wall of the drum and the back panel of the outer cabinet, wherein the insulation panel occupies the arcuate recess and partially surrounds the airway to define the airflow path within the interstitial space, wherein the insulation panel is further configured to prevent accumulation of lint within the arcuate recess, and wherein the back panel includes a pivot that attaches the rotating drum to the outer cabinet, wherein the pivot extends through the insulation panel.

17. The drying appliance of claim 16, wherein the insulation panel is configured to prevent thermal transfer from a processing space within the rotating drum and an area rearward of the back panel.

18. The drying appliance of claim 16, wherein the insulation panel is coupled to the back panel.

19. The drying appliance of claim 16, wherein the insulation panel has a consistent thickness.

20. The drying appliance of claim 16, wherein the back panel includes structural channels, and wherein the insulation panel includes indentations that matingly engage the structural channels.

* * * * *